United States Patent [19]

Chan et al.

[11] Patent Number: 4,460,945

[45] Date of Patent: Jul. 17, 1984

[54] LUMINAIRE SHIELD

[75] Inventors: Alexius C. Chan, Hacienda Heights; Phillip L. Wheeler, Laguna Hills; Lloyd H. Chandler, Orange, all of Calif.

[73] Assignee: Southern California Edison Company, Inc., Rosemead, Calif.

[21] Appl. No.: 431,811

[22] Filed: Sep. 30, 1982

[51] Int. Cl.[3] ..... F21V 29/00

[52] U.S. Cl. ..... 362/294; 362/255; 362/268; 362/307; 362/308; 362/310; 362/311; 362/355; 362/373; 362/376; 362/457

[58] Field of Search ..... 362/268, 255, 294, 307, 362/308, 310, 311, 355, 373, 376, 457

[56] References Cited

U.S. PATENT DOCUMENTS

| | | | |
|---|---|---|---|
| 3,315,072 | 4/1967 | Harling | 240/2.5 |
| 4,010,362 | 3/1977 | Fletcher | 240/147 |
| 4,160,286 | 7/1979 | Merritt | 362/376 X |

*Primary Examiner*—Stephen J. Lechert, Jr.
*Attorney, Agent, or Firm*—Lyon & Lyon

[57] ABSTRACT

A luminaire shield, particularly for protecting street lights from breakage by vandals includes a laminate plate mounted in spaced relationship from the lens of the luminaire. Heat can thereby escape between an air gap and between the light source housing and the shield, and the shield extends beyond the lens with a tail portion covering the electrical converter (ballast) mounted within the luminaire housing, such that this is also protected.

3 Claims, 2 Drawing Figures

LUMINAIRE SHIELD

BACKGROUND OF THE INVENTION

This invention relates to shields for luminaire lenses, light bulbs and ballasts. In particular the invention relates to street light luminaires.

Lenses are usually provided to diffuse light from a light source of a luminaire and to provide protection to such light source. Conventionally, such light-diffusing lenses are made of glass and, when subject to destruction by vandalism requires frequent replacement. Those light diffusing lenses which are made of synthetics such as polycarbonate resin, although having a higher impact resistance, are problematic where the light source is of relatively high wattage since the heat and ultra-violet radiation from the light source discolors and possibly deforms such lenses.

It is accordingly a requirement to provide a luminaire shield which is of a material and shape which will effectively protect the lamp and the light diffusing lens of the luminaire and associated light generating elements from rocks or bullets, and simultaneously will not become discolored.

SUMMARY OF THE INVENTION

According to the invention a luminaire comprising a housing and a light source which includes an electrical converter element (ballast), a lamp socket for receiving a lamp and a light diffusing lens mounted in an aperture in the housing provides a transparent shield mounted on the bottom of the housing remote from the light source with a space between the lens and the shield so as to define an air gap. Heat generated by the light source is thereby permitted to escape through an air gap.

DETAILED DESCRIPTION OF PREFERRED EMBODIMENT

Figure 1:
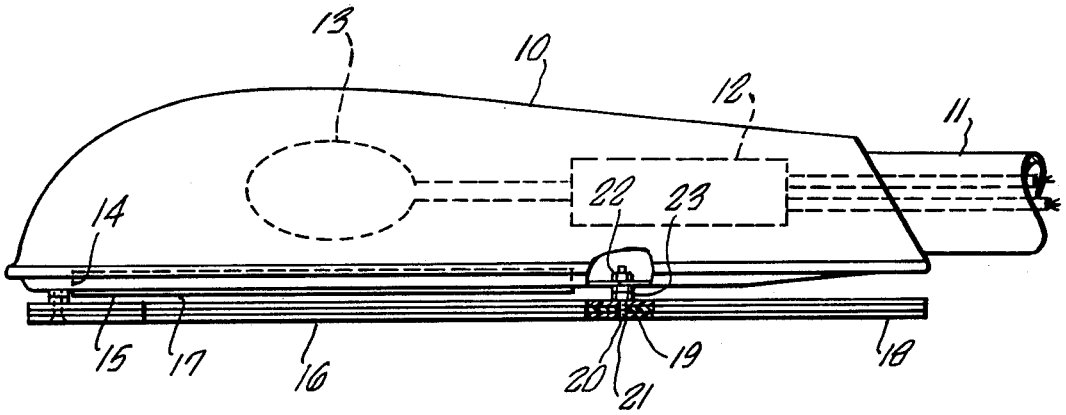
FIG. 1 is a side elevation of a street light having a shield in accordance with the present invention.
Figure 2:
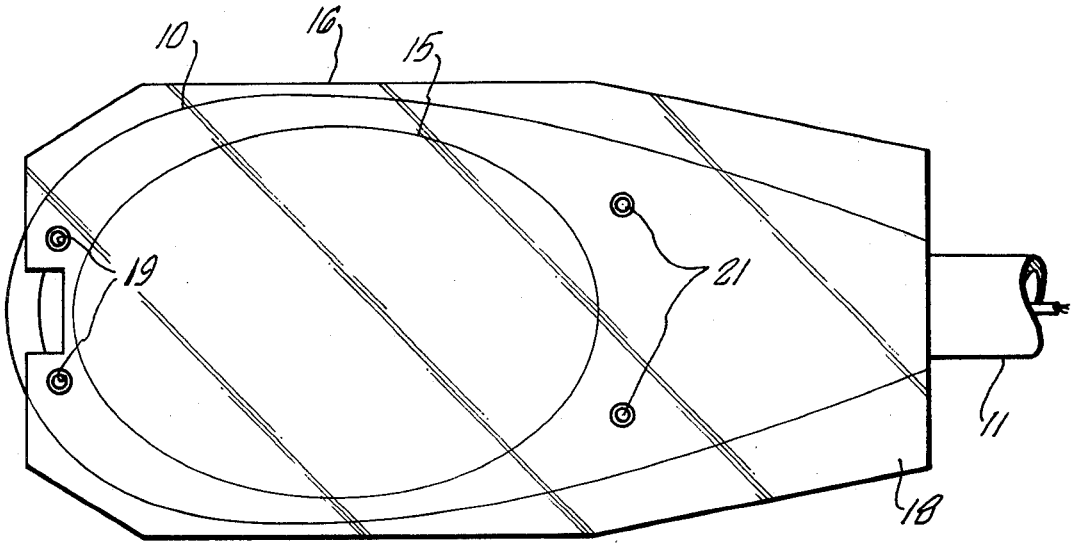
FIG. 2 is a plan elevation illustrating the luminaire shield and the lens through said shield.

A luminaire constituting a conventional street light includes housing 10 which is mounted at the end of a mast arm 11 attached to a street light standard or pole. The housing 10 locates a light source which includes an electrical converter 12 shown in phantom in FIG. 1. The electrical converter element 12 is connected with a lamp 13, also shown in phantom in FIG. 1. The wattage of such a lamp will be in the order of 50 watts through 400 watts and as such generates substantial heat in the housing 10. The housing 10 provides an aperture 14 mounting a light diffusing lens 15.

A transparent shield 16 is mounted on the bottom of the housing 10 remote from the lamp 13 and electric converter 12 with a space between the lens 15 and the shield 16. Thereby an air gap or vent 17 is defined about at least part of the shield perimeter so that heat generated by the lamp 13 is permitted to escape through the air gap 17.

The shield 16 is provided with a tail portion 18 which extends over the housing thereby to protect the converter 12 within the housing 10.

The shield 16 is constituted by a laminate material which is commercially known as Lexgard (Trademark) and is about $\frac{3}{4}$ inch thick and constituted by three layers which are composites of Lexan (Trademark) polycarbonic sheet and Lexan mar-resistant polycarbonic sheet, the laminates containing an ultra-violet light stabilizer additive to prevent yellowing or discoloration with heat and aging. Between the Lexan materials is a sheet of acrylic material. Such material is ideally suitable to bullet resistance, and thus will constitute an effective transparent shield for the luminaire.

A bore 19 is formed in four places in the shield and countersunk formations 20 are made through the material to receive the head of a bolt 21. The free end of the bolt receives a nut 22 which is contained in the housing 10 of the luminaire, and the extent of the bolt is sufficient to provide for spacer elements 23 to be placed between the shield 16 and the housing 10 so that an effective air gap is provided between the lens 15 and the shield 16.

The shape of the shield 16 conforms substantially to a planar surface which generally follows the planar shape of the street light as will be viewed from the street level. Thus, an effective protection is provided to the luminaire components, being the lens 15, lamp 13, and converter 12.

Installation of the shield is simple, fast, and reliable and effectively protects the street light lens over an extended period without discoloration from heat, while preventing the penetration of a projectile to otherwise damage the major and/or expensive working parts of the luminaire.

In other embodiments of the invention the shield may include a boxlike shape so as to protect more of the housing of the luminaire.

While the present invention has been described with reference to particular embodiments thereof, it will be understood that numerous modifications may be made by those skilled in the art without departing from the scope of the invention. Therefore, the appended claims are intended to cover all such equivalent variations as come within the spirit and scope of the present invention.

I claim:

1. A luminaire comprising a housing for a light source, said light source including an electric converter element, a lamp socket for receiving a lamp, a light diffusing lens mounted in an aperture in the housing, and a transparent laminate shield mounted on the bottom of the housing remote from the light source, and with the lens between the light source and shield, the shield being spaced from the lens about at least part of the shield perimeter to form a vent between said part of the perimeter and the lens whereby heat generated by the light source is permitted to escape through said vent, said shield having a planar surface substantially parallel to the light diffusing lens, and extending to protect the electric converter element, said shield being of a thickness sufficient to protect the lens and converter element against a firearm projectile.

2. A luminaire as claimed in claim 1 wherein the shield is spaced from the lens by means of washer type elements.

3. A luminaire comprising a housing for a light source, said light source including an electric converter element, a lamp socket for receiving a lamp, a light diffusing lens mounted in an aperture in the housing, and a transparent laminate shield mounted on the bottom of the housing remote from the light source, and with the lens between the light source and shield, the shield being spaced from the lens about at least part of the shield perimeter to form a vent between said part of the perimeter and the lens whereby heat generated by the light source is permitted to escape through said vent, said shield being of a thickness sufficient to protect the lens and converter element against a firearm projectile.

* * * * *